United States Patent [19]

Baker

[11] 3,932,916

[45] Jan. 20, 1976

[54] CAPTIVE ELEMENT RELEASE MECHANISM

[76] Inventor: Curtis K. Baker, 25 Tally Ho Drive, Warminster, Pa. 18974

[22] Filed: Nov. 4, 1974

[21] Appl. No.: 520,315

[52] U.S. Cl. ..... 24/211 N; 85/5 B; 74/527

[51] Int. Cl.[2] ..... G05G 5/06; A44B 17/00

[58] Field of Search ..... 24/211 N, 211 R, 230 AV; 85/5 B; 294/83 AA; 74/2, 527

[56] References Cited

UNITED STATES PATENTS

| | | | |
|---|---|---|---|
| 1,861,099 | 5/1932 | Smith | 294/83 AA |
| 2,259,257 | 10/1941 | MacBlane | 24/211 N |
| 3,477,333 | 11/1969 | Boyd et al. | 85/5 B |

*Primary Examiner*—Donald A. Griffin
*Attorney, Agent, or Firm*—R. S. Sciascia; Henry Hansen

[57] ABSTRACT

A device for securely retaining a captive element and for reliably releasing said element upon rotation of a control shaft. In its elemental form the device includes a hollow cylindrical sleeve with apertures in the side walls containing ball detents. A captive element fits over the outside of the sleeve and a control shaft reposes within the sleeve. A portion of the control shaft is so formed that the ball detents are forced partially through the apertures in the sleeve and into mating recesses in the captive element when the control shaft is rotated to a first position. When the control shaft is rotated 45° from the first position the ball detents are released thereby freeing the captive element.

4 Claims, 6 Drawing Figures

CAPTIVE ELEMENT RELEASE MECHANISM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to captive element release mechanisms and in particular to such mechanisms wherein the captive element is held in place by movable ball detents.

Current captive element release mechanisms commonly employ a retaining sleeve provided with cylindrical guide holes spaced around the circumference of the sleeve. Spherical ball detents are crimp retained within the guide holes in such manner that the balls are captive but free to move a limited distance such that part of the surface of the spherical ball detents protrude either into the interior of the sleeve or extend beyond the outer surface of the sleeve into retaining contact with a captive element. A longitudinally movable control shaft reposes within the sleeve. In a first position the periphery of the control shaft engages the detents along a region where the control shaft has its greatest circumference to thereby urge the detents outward to the maximum extent. After the control shaft has been longitudinally moved to a second position, the periphery of the control shaft engages the detents along a region where the control shaft has a reduced diameter to thereby allow the detents to retract to such an extent that they no longer protrude beyond the outer surface of the sleeve and thus free the captive element.

Current captive element release mechanisms of the type just described have control shafts which tend to have weak cross-sectional areas. In addition, impact or other forces directed along the longitudinal axis of the control shaft may deform the control shaft to such an extent that intentional longitudinal motion must be abnormally forced or, in the extreme, cannot be made at all.

SUMMARY OF THE INVENTION

Accordingly, it is an object of this invention to provide a captive element release mechanism which is rugged and which is not prone to failure under the influence of unwanted forces directed along the longitudinal axis of a control shaft. These and other objects of the invention are achieved as follows:

In its elemental form the captive element release mechanism of the present invention includes a cylindrical sleeve containing apertures positioned at diametrically opposed points. A rotatable control shaft reposes within the sleeve and a captive element, e.g., another sleeve-like device, fits over the outer surface of the sleeve. Each of the aforesaid apertures contains ball detents. A portion of the control shaft is so formed that the ball detents are forced to partially protrude beyond the outer surface of the sleeve to thereby mate with complimentary recesses in the surface of the captive element when the control shaft is rotated to a first position. As the control shaft is rotated 45° from the first position, the control shaft presents a reduced dimension to the ball detents to thereby permit the ball detents to retract to such an extent that the captive element is freed.

Other objects, advantages and novel features of the invention will become apparent from the following detailed description of the invention when considered in conjunction with the accompanying drawings.

BRIEF DESCRIPTION OF THE DRAWINGS

FIG. 2*c* is an enlarged and exaggerated cross-sectional view of the control shaft shown in FIG. 2*a.

DESCRIPTION OF THE PREFERRED EMBODIMENT

Figure 1:
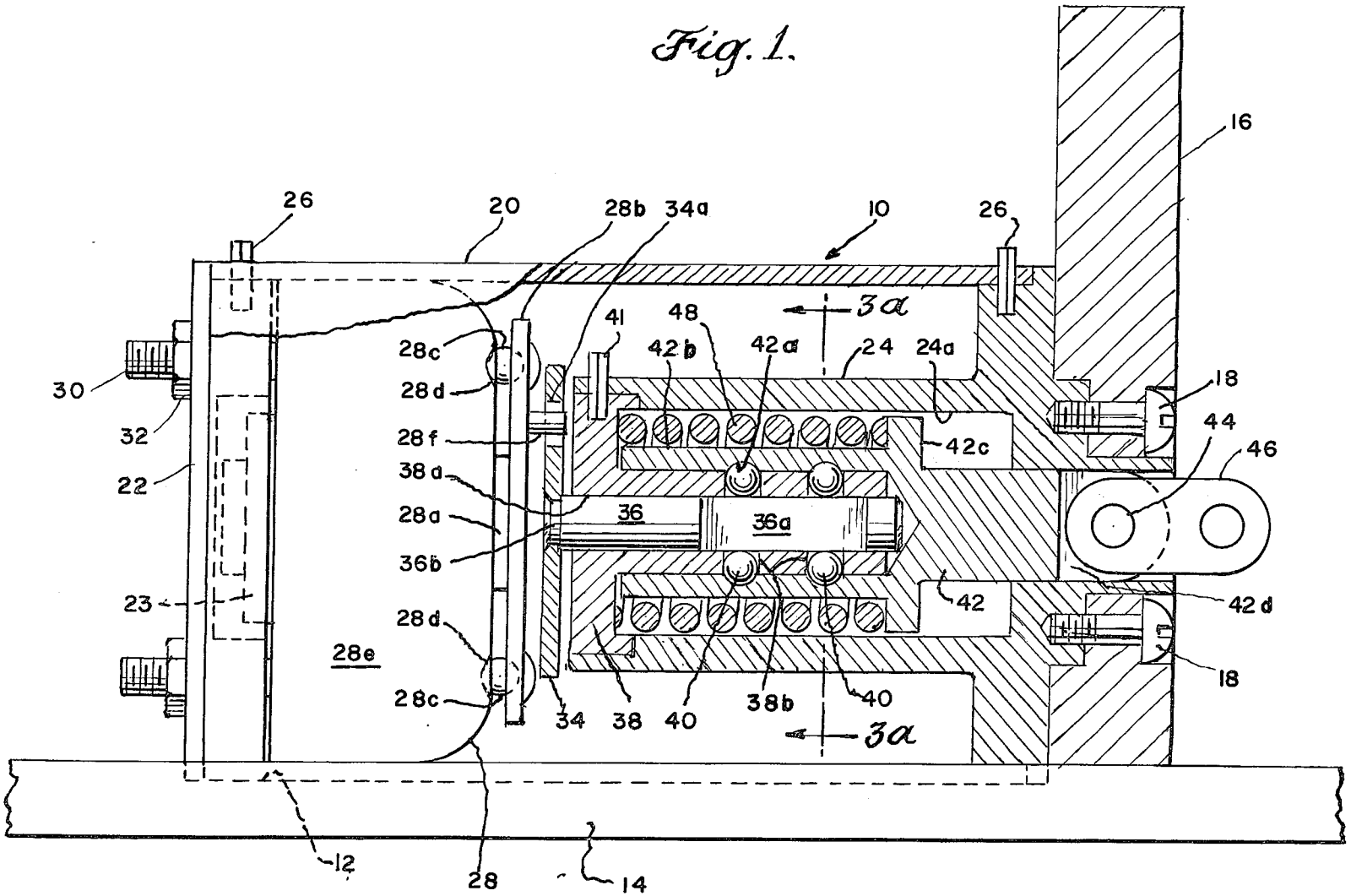
FIG. 1 shows a captive element release mechanism according to the invention.

Referring to FIG. 1, the captive element release mechanism 10 of the present invention is shown in partial cross section. The mechanism rests within an arcuate recess 12 machined from the surface of a baseplate 14 and is secured to an upright 16 with bolts 18. The working elements of the mechanism 10 are enclosed within a cylindrical casing 20 which is secured to a stud plate 22 and to a thrust bulkhead 24 with spring pins 26 or other suitable means such as threaded screws. The thrust bulkhead 24 is provided with a cylindrical cavity 24*a* and may optionally be provided with vent ports (not shown) to minimize compression or vacuum effects as a thrust piston 42 is released or reset as explained more fully hereinbelow.

A conventional rotary solenoid 28 is secured to the stud plate 22 with studs 30 and lock nuts 32. The rotary solenoid 28 includes an armature 28*a* which is secured to a disc shaped armature drive plate 28*b*. The drive plate 28*b* keeps a plurality of ball bearings 28*c* in intimate contact with a like plurality of coined ball races 28*d* on the surface of the rotary solenoid case 28*e*. The coined ball races 28*d* are arcuate and inclined; i.e., one end of each ball race 28*d* is deeper than the other end. As is well-known in the art, the conventional rotary solenoid 28 employs the inclined plane of the ball races 28*d* to convert linear motion to rotary motion. When the armature coil (not shown) is energized from a properly sized DC voltage source (not shown) an air gap is closed under the influence of magnetic forces and the armature 28*a* is drawn into the armature casing 28*e*. The armature 28*a* is forced to rotate because it is supported by the plurality of ball bearings 28*c* that move around and down their respective inclined ball races 28*d*. As is well-known in the art the coining of the solenoid case 28*e* and complimentary coining of the armature drive plate 28*b* determines the length and direction of the rotary stroke and the value of the starting torque. After power is removed from the solenoid coil, the armature is returned to the index position by means of a scroll type return spring 23. A rotary solenoid suitable for use with the present invention is the LEDEX rotary solenoid, size 5S, part number 129734-026 or equivalent; a more complete description of the physical and operating characteristics of such conventional rotary solenoids may be found in catalog C-1000, April 1970, of the Ledex Division, Ledex Inc., 123 Webster Street, Dayton, Ohio 45401.

The armature drive plate 28*b* includes a cylindrical shaped drive pin 28*f* secured to and projecting from the surface of the drive plate 28*b*. The drive pin 28*f* is adapted to repose within a bore 34*a* located in one end of an oblong drive arm 34. The drive pin 28*f* drivingly engages the drive arm 34 to thereby rotate the drive arm 34 in unison with the armature 28*a* and the drive plate 28*b* when the rotary solenoid 28 is energized as set forth above. The drive pin 28*f* is of sufficient length so as to remain in driving engagement with the bore 34*a* during the spiral motion of the armature 28*a* and the drive plate 28*b*.

The drive arm 34 is fixedly secured to a generally cylindrical rotatable control shaft 36 provided with an elongated flattened release blade 36*a* intermediate its ends. The control shaft reposes within a through-bore 38*a* provided in a stationary monolithic stator 38. The stator 38 may be characterized as a flanged barrel having a generally T-shaped cross-section and is secured to the thrust bulkhead 24 with spring pins 41. The stator 38 is provided with four transverse generally cylindrical apertures 38*b* which extend through the sidewalls of the stator 38. Each of the apertures 38*b* accommodates a ball bearing 40. Under the influence of the release blade 36*a* each of the ball bearings 40 has part of their respective surfaces urged beyond the outer surface of the stator 38*b* into retaining contact with annular grooves or recesses 42*a* located on the inner surface of a captive element or thrust piston 42.

The thrust piston 42 includes a cylindrical sleeve-like portion 42*b* which fits over the outer surface of the stator 38; the sleeve portion 42*b* includes the annular grooves or recesses 42*a*. Intermediate its ends the thrust piston 42 is provided with an annular flange 42*c*. Extending from the flange 42*c* is a generally cylindrical projection which terminates in a clevis 42*d*. The clevis 42*d* is transversely bored through and accommodates a connecting pin 44 which secures a thrust link 46 to the thrust piston 42.

A thrust spring 48 reposes within the thrust bulkhead cavity 24*a* and is lodged between the thrust piston flange 42*c* and the stator 38 flange. The thrust spring 48 functions to urge the thrust piston 42 to the right after the ball bearings 40 have been retracted from the annular grooves 42*a* as explained hereinbelow.

Figure 2A:
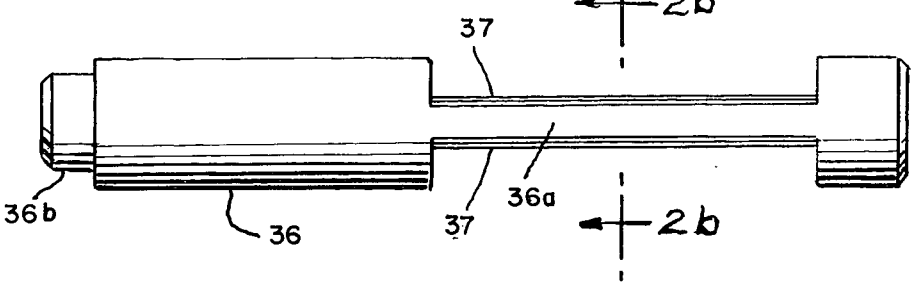
FIG. 2*a* is an isolated view of a control shaft which forms part of the release mechanism shown in FIG. 1.
Figure 2B:
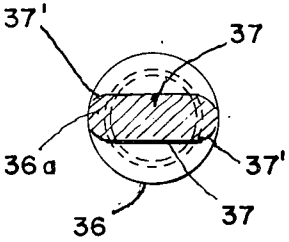
FIG. 2*b* is a cross-sectional view of the control shaft shown in FIG. 2*a;*

Referring to FIGS. 2*a* and 2*b*, the construction of the release blade 36*a* is shown more clearly in an isolated view of the control shaft 36. The control shaft 36 is shown in FIG. 2*a* with the same left-right orientation portrayed in FIG. 1 but is portrayed in FIG. 2*a* as if viewed from the top of FIG. 1. The release blade 36*a* is formed by removing a portion of the cylindrical control shaft 36 from each side of its center line so as to form flats 37. The flats are required to be parallel to the drive arm 34 center line within $\pm 2°$. The drive arm 34 is fixedly secured to a stub 36*b*, by welding or other suitable means, which forms the left terminus of the control shaft 36.

Figure 2C:
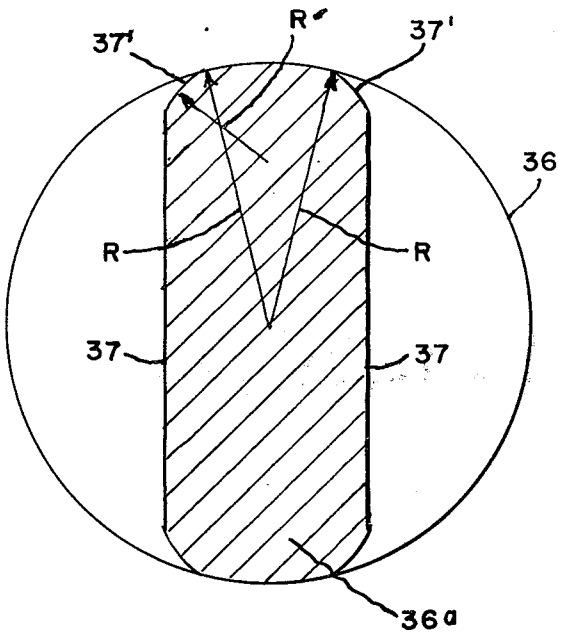

Referring to FIG. 2*c*, to prevent metal chipping, to provide a secondary control surface and to enhance the snap action of the release blade 36*a*, each of the four edges 37′ along the entire length of the two flats 37 is rounded off approximately 0.010 inches or to another desired radius $R^-$. By rounding off the edges 37′ to a radius, $R^-$, less than the maximum radius, R, of the remaining arcuate portion of the control blade 36*a*, a side force is introduced from the ball bearings 40 as the control shaft 36 is caused to rotate from its index position to its final position by the solenoid 28. The side force is generated by the thrust spring 48 impressing a force against the thrust piston 42 which in turn impresses a force against the ball bearings 40; the ball bearings in turn transmit some of this force to the release blade 36*a* when the release blade 36*a* has rotated to the point where the reduced radius rounded edges 37′ are in contact with the ball bearings 40. By designing the control blade 36*a* so that side forces are generated, the solenoid 28 need not be principally relied upon to drive the control shaft 36 to its final position. That is, as long as the solenoid has sufficient power to drive the control shaft 36 such that the rounded edges 37′ of the release blade 36*a* are presented to the ball bearings 40, the side forces generated by the thrust spring 48 will carry the control shaft 36 to its final position.

Figure 3A:
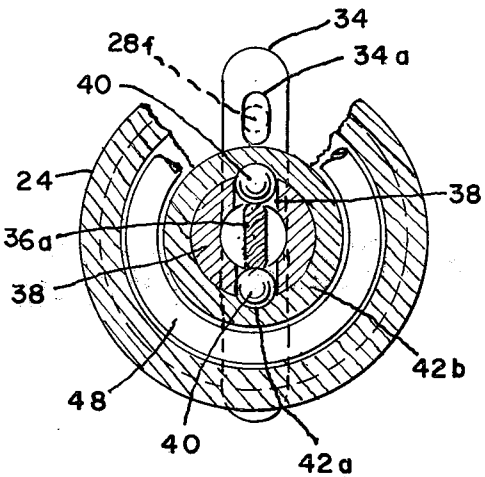
* and FIGS. 3*a* and 3*b* are cross-sectional views of the release mechanism shown in FIG. 1 as it appears in the index or ready position and in the operated or released position respectively.
Figure 3B:
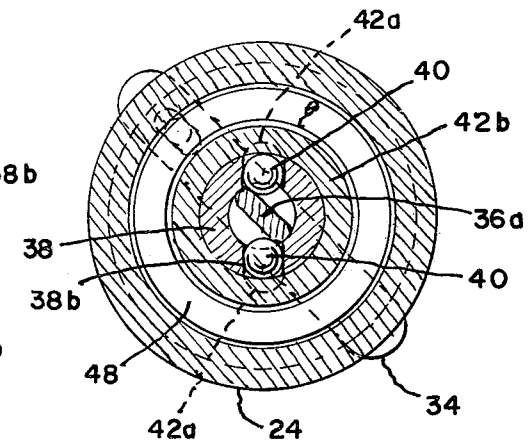

FIGS. 3*a* and 3*b* are simplified cross-sections, along the line 3A in FIG. 1, which show the positional relationships of the release stem 36*a*, the ball bearings 40 and the captive element 42 in the ready or index position and in the released position respectively.

Operation of the captive element release mechanism 10 is as follows. In the ready position shown in FIG. 3*a*, the release blade 36*a* presents its greatest dimension underneath the ball bearings 40 and thereby urges a portion of the ball bearings beyond the outer surface of the apertured stator 38 and into mating contact with the annular grooves 42*a* in the thrust piston 42. The thrust piston 42 is thus locked in place by the retaining action of the ball bearings 40. The ball bearings 40 are required to be dimensioned with respect to the apertures 38*b* and the thickness of the stator 38 barrel so that the center line of each ball bearing 40 always lies below the outer surface of the stator 38 barrel when the control blade 36*a* is in the index position; satisfaction of this criterion prevents inadvertent jamming of the ball bearings which could lead to faulty operation of the release mechanism 10.

The release mechanism 10 reaches the release position shown in FIG. 3*b* in the following manner. After the rotary solenoid 28 is energized, the control shaft 36 begins to rotate counterclockwise. When the secondary control surfaces 37′ on the control blade 36*a* come in contact with the ball bearings 40, the ball contact edges of the annular grooves 42*a* force the balls 40 inwardly in response to the forces generated by the compressed spring 48 which has moved the thrust piston 42 an arc depressant distance. The balls 40 are forced inwardly because their center lines initially lay below the outer surface of the stator 38; hence, the ball contact edges of the annular grooves 42*a* generate downwardly directed forces on the balls 40. In other words, the ball bearings 40 are forced inwardly and ultimately into contact with the now inclined faces 37 of the control blade 36*b* by the action of the compressed spring 48 applying a downwardly directed force to the balls via the thrust piston 42. The ball bearings 40 are urged inwardly to such an extent that they no longer partially extend beyond the outer surface of the stator 38 and thus are no longer in retaining contact with the annular grooves 42*a*. After the ball bearings 40 have been forced inwardly, the thrust piston is completely freed of the restraining influence of the ball bearings 40 and moves to the right under the influence of the thrust spring 48. The thrust piston 42 in turn imparts a translational motion to the thrust link 46 which can be attached to any suitable device, such as the toggle point of a linkage (not shown), to perform useful work, e.g., to toggle the linkage.

After the thrust piston 42 has been released, power is removed from the solenoid 28 and the control shaft 36 remains in the position shown in FIG. 3*b* until the mechanism 10 is reset. It should be noted that the scroll type return spring 23 is tensioned after the thrust piston 42 is released and normally urges the control shaft 36 back to the index position shown in FIG. 3*a*. However, the annular grooves 42*a* of the thrust piston 42 have moved out of registration with the apertures 38*b* in the stator 38 and the smooth cylindrical walls of the thrust piston sleeve portion 42*b* are positioned over the apertures 38*b* as shown in FIG. 3b. Hence, even in the released position the balls 40 are under load and prevent the non tensioned scroll spring 23 from returning the control shaft 36 to the index position.

Reset of the mechanism is accomplished as follows. The thrust piston 42 is pushed inwardly (FIG. 1) either manually or mechanically to thereby place the annular grooves 42a in registration with the apertures 38*b* and to also compress the thrust spring 48. When the grooves 42a and apertures 38*b* are in registration, the inward directed loads on the balls 40 is lessened to the extent that the scroll type return spring 23 is able to rotate the control shaft 36 clockwise to the index position shown in FIG. 3*a* to thereby urge the balls 40 partially through the apertures 38*b* and into mating contact with the annular grooves 42*a*. When the balls 40 are seated in the annular grooves 42*a*, the mechanism 10 is reset and the inward directed force on the thrust piston 42 may be removed.

Some of the more subtle advantages of the present invention over the prior art will now be set forth. With further reference to FIG. 2*c*, the control blade 36*a* may be characterized as a composite of two control surfaces.

The primary control surface lies along the arc which subtends the angle $\theta$; the radius of the arcuate primary surface is the radius R of the control shaft 36. In the index position, the center of the ball bearings 40 and the center of the control shaft 36 lie in the same vertical plane. Therefore any unwanted extraneous forces which tend to rotate the control shaft must move the control shaft at least $\theta/2°$ before the release mechanism 10 is tripped. It is clear, therefore, that the sensitivity of the release mechanism 10 to extraneous forces may be controlled by varying the angle $\theta$ and hence the arcuate distance of the primary control surface. The stability of the release mechanism is further enhanced by the scroll spring 23 which is virtually untensioned when the control blade 36*a* is in the index position. As the control blade 36a moves away from the index position the scroll spring 23 is tensioned and therefore tends to urge the control blade 36a back to the index position.

The secondary control surface 37' lies along the reduced radius $R^-$. As stated hereinbefore, when the ball bearings 40 come in contact with the secondary control surface 37', they impress a force on the control blade 36*a* which assists the control blade 36*a* in reaching its final or released position. The magnitude of this force may be controlled by varying the magnitude of the reduced radius $R^-$.

Lastly, the cross-sectional area of the control blade 36*a* is greater than the cross-sectional area of the control member generally used in prior art release mechanism which release upon longitudinal motion. Such prior art control members generally have a circular cross-section. It should be clear from FIG. 2*c* that the cross-sectional area of the control blade 36*a* is larger than a circular cross-section which permits the same ball retraction as the control blade 36*a*. Hence the strength of the control shaft 36 is enhanced.

The control blade 36*a* may be rotated to a release angle of other than 45°, although 45° is the preferred angle for the embodiment shown in the drawings because the ball bearings 40 impress a maximum moment ($F \times r$) on the control blade flats 37 when the control blade 36*a* has rotated to approximately 45°.

With further reference to FIG. 1, it should be clear the motion of the thrust piston 42 to the right tends to compress the residual air in the bulkhead cavity 24*a*. Compression or vacuum effects are negligible if the release mechanism 10 is constructed with large tolerances. If the release mechanism 10 is constructed with close fitting parts, it may be desirable to provide vent ports in the bulkhead 24 or, alternatively, to vent the cavity 24*a* through pots provided in the thrust piston.

Obviously many modifications and variations of the present invention are possible in the light of the above teachings, e.g., the thrust piston 42 may be hydraulically or pneumatically driven instead of being spring driven and the rotary solenoid 28 may be removed to allow the drive arm 34 to be manually rotated or manually released and scroll spring returned. It is therefore to be understood that within the scope of the appended claims the invention may be practiced otherwise than as specifically described.

I claim:

1. An apparatus comprising:

a barrel member having a shank, an axial bore through the shank and a plurality of radial apertures communicating with said axial bore;

a locking member mounted in each of said plurality of apertures for radial movement between a retracted position within said shank and a locking position extending radially from said shank;

a control blade rotatably mounted in the axial bore and having a control surface for cam action against said locking members to urge the locking members from said retracted position to said locking position, said control blade comprising two substantially rectangular parallel surfaces joined at the extremities thereof by two arcuate surfaces wherein each of said arcuate surfaces has a first portion intermediate its ends having a radius equal to the radius of the control shaft and second and third portions each extending from said first portion to a respective one of said two parallel surfaces along an arc having a radius less than the control shaft radius; and means operatively connected to said control blade for rotating said control blade.

2. An apparatus according to claim 1 further including:

a sleeve member having an inner surface provided with a plurality of recesses and slidably mounted on said barrel member for movement between a first position wherein said recesses are in registration with said apertures and a second position wherein said recesses are out of registration with said apertures.

3. An apparatus according to claim 2 further including: bias means operatively connected to said sleeve member for urging said sleeve member to said second position.

4. An apparatus comprising:

a barrel member having a shank, an axial bore through the shank and a plurality of radial apertures communicating with said axial bore;

a locking member mounted in each of said plurality of apertures for radial movement between a retracted position within said shank and a locking position extending radially from said shank;

a control shaft mounted in the axial bore for rotational movement between an index position and a released position;

said control shaft having a control blade intermediate its ends for cam action against said locking members to urge the locking members from said retracted position to said locking position as said control shaft rotates to said index position and to permit said locking members to return to said retracted position as said control shaft rotates to said released position, said control blade comprising two substantially rectangular parallel surfaces joined at the extremities thereof by two arcuate surfaces wherein each of said arcuate surfaces has a first portion intermediate its ends having a radius equal to the radius of the control shaft and second and third portions each extending from said first portion to a respective one of said two parallel surfaces along an arc having a radius less than the control shaft radius;

means operatively connected to said control shaft for rotating said control shaft between said index position and said released position;

a sleeve member having an inner surface provided with a plurality of recesses and slidably mounted on said barrel member for movement between a first position wherein said recesses are in registration with said apertures and a second position wherein said recesses are out of registration with said apertures; and bias means operatively connected to said sleeve member for urging said sleeve member to said second position.

* * * * *